US006506008B2

(12) United States Patent
Merkli

(10) Patent No.: US 6,506,008 B2
(45) Date of Patent: Jan. 14, 2003

(54) DEVICE AND METHOD FOR AUTOMATICALLY TRIMMING THE OPEN SIDE EDGES OF BOUND PRINTED PRODUCTS

(75) Inventor: Peter Merkli, Oftringen (CH)

(73) Assignee: Grapha Holding AG (CH)

( * ) Notice: Subject to any disclaimer, the term of this patent is extended or adjusted under 35 U.S.C. 154(b) by 0 days.

(21) Appl. No.: 09/922,710

(22) Filed: Aug. 7, 2001

(65) Prior Publication Data

US 2002/0018701 A1 Feb. 14, 2002

(30) Foreign Application Priority Data

Aug. 7, 2000 (EP) ..... 00810705

(51) Int. Cl.[7] ..... B42B 9/00

(52) U.S. Cl. ..... 412/1; 412/9; 412/16; 412/22; 412/32; 270/52.17

(58) Field of Search ..... 412/1, 4, 6, 9, 412/14, 16, 18, 30, 22, 32; 270/52.16, 52.17; 83/422

(56) References Cited

U.S. PATENT DOCUMENTS

RE28,840 E * 6/1976 Sarring ..... 83/633
5,678,813 A * 10/1997 Osako et al. ..... 412/4

FOREIGN PATENT DOCUMENTS

DE 39 38 285 6/1990
EP 0 687 532 12/1995
EP 0 842 746 5/1998
FR 1 228 264 8/1960
GB 2 113 597 8/1983

OTHER PUBLICATIONS

Mueller Martini, "The Three–Knife Trimmer With Exclusive Shear Cutting Action", Merit S, pp. 2–6, printed in Switzerland.

* cited by examiner

*Primary Examiner*—Willmon Fridie, Jr.
(74) *Attorney, Agent, or Firm*—Venable; Robert Kinberg

(57) ABSTRACT

An apparatus is provided for automatically trimming tree open side edges of printed products bound along a fourth edge to a desired format for each printed product. The printed products are transported in a transport direction along a surface of a trimming table. First, second and third trimming stations are located one after the other in the transport direction along the trimming table. Each trimming station includes a trimming device having at least one stationary blade that can be driven in a plane extending perpendicular to the surface of the trimming table, a positioning device for positioning one of the open side edges of a respective printed product on the trimming table to be cut, and a pressing device, with which a respective positioned printed product can be pressed over essentially the entire format during a out of the positioned open side edge. A transport device transports a respective printed product from the first trimming station to the second trimming station, and from the second trimming station to the third trimming station.

10 Claims, 4 Drawing Sheets

21'
B'
17'
23'
3'
7'
20
A'
1'
18'
12'
22'
2'
6'
16'
31'''
C'
24'

39
26
A''
45
12'
B''
28
7''
12''
30
C''
31
46
46'
46''
41
8
42
25
40
31'
27
29
31''
9
38

1'''
A'''
47
54
50
51
52
B'''
2'''
3'''
C'''
53
48
49
6'''
55
58
57
56
59
61
48

DEVICE AND METHOD FOR AUTOMATICALLY TRIMMING THE OPEN SIDE EDGES OF BOUND PRINTED PRODUCTS

CROSS-REFERENCE TO RELATED APPLICATION

This application claims the priority of European Patent Application No. 00810705.4-2302 filed Aug. 7, 2000, the disclosure of which is incorporated herein by reference.

BACKGROUND OF THE INVENTION

The invention relates to an apparatus for automatically trimming the open side edges of bound printed products, such as books or brochures. Such an apparatus includes a trimming station which has a trimming device with at least one blade that can be driven in a plane extending perpendicular to the extension of the printed products. A positioning device is provided with which a respective side edge of the printed products can be positioned for a cut on a trimming table. A pressing device presses the positioned printed products over essentially the entire format for the cut.

An apparatus of this type is commercially available under the name "Merit S" by Müller-Martini AG. The apparatus is a so-called three-side trimmer that has a blade for the front cut, the blade being disposed in a trimming station and oriented transversely to the transport direction, and two blades for making the top and bottom cuts which are spaced from one another and oriented in the transport direction. Conveyor belts transport the untrimmed printed products to the trimming station, where they are precisely aligned. A pressing plunger presses the positioned printed products. The pressing pressure is pneumatlly adjusted. Trimming is effected against plastic trimming tabs.

For assuring a high trimming quality, even in books having a thickness of, for example, 4 cm, in the "Merit S" the pressing plunger presses the printed products essentially over the entire format. The pressing plunger is therefore format-specific. If a for changes, a new pressing plunger must be mounted. This device is therefore only suitable for mass production. For producing short runs or individual products with continuously-changing formats, the pressing plungers would have to be exchanged for each format change, and the trimming mechanisms would have to be adjusted to the format. It is therefore not economical to produce short runs or individual products with this device.

EP 0 842 746 A discloses a device for trimming the open side edges of bound printed products, in which two respective printed products to be processed are positioned on a rotatable clamping device. The open side edges are t ed consecutively with one blade; the printed products are rotated after a cut. In this case, the printed products are only pressed in a comparatively small region. Also in this device, if the entire format is supposed to be pressed, the pressing plunger must be exchanged when the format changes.

SUMMARY OF THE INVENTION

It is an object of the invention to produce a device of the aforementioned type that assures a high trimming quality in the trimming of books and brochures, and is also suitable for short runs and individual products.

The above and other objects are accomplished in accordance with the invention by the provision of an apparatus for automatically trimming the open side edges of bound printed products as first described above, wherein two further trimming stations and a transport device are provided for transporting a respective printed product from the first trimming station to the second trimming station, and from the second trimming station to the third trimming station, and each of the three open side edges of the printed products is trimmed with a stationary blade in each trimming station.

According to a further aspect of the invention there is provided a method for implementing the apparatus of the invention.

In the apparatus and method of the invention, the three-sided trimming of a book occurs not in a single trimming station, but sequentially in a plurality of consecutive, staggered trimming stations. The pressing device of each trimming station, and particularly the pressing plunger, can be tailored to a maximum format. In printed products having a smaller format, the pressing plunger can harmlessly protrude beyond the printed product at the sides that are not to be trimmed in the respective trimming station. Thus, all printed products having the maximum format or a smaller format can be pressed and trimmed without necessitating the exchange of the pressing plungers. It is thus not necessary to exchange the pressing plunger when the format is changed. Because each trimming station only requires a single blade, these massive blades can always maintain a fixed position. No complicated adjustment procedure is needed.

It is possible to process an arbitrary sequence of book sizes consecutively, economically and with a high output, when, in accordance with a modification of the invention, adjustable stops are provided in the individual trimming stations for positioning and aligning the printed products to be trimmed. This adjustment can be made from cycle to cycle, so an arbitrary sequence of book sizes can be processed consecutively and simply. In accordance with a modification of the invention, spring-loaded pressing plungers accommodate a change in the book thickness. If the book thickness changes, therefore, the pressing plungers need not be adjusted to the thickness of the printed products.

A further advantage of the device according to the invention is that the order of the cuts can be arbitrarily selected and therefore customized for the printed products. The top, bottom and front cuts can therefore be made in a random order. The trimming stations can be arranged consecutively in a line. Other arrangements are also possible, however. In particular, the trimming stations can be arranged such that for example, printed products having the smallest format or printed products having the largest format can be guided through the trimming stations in a straight line. The corresponding printed products, for example those having the smallest format, may then be subjected to only minimal lateral adjustments in the individual stations. The arrangement of the individual stations can therefore be tailored to the user's needs. The trimming stations can be offset from one another, for example, or arranged such that the printed products are guided through the trimming stations at an angle with respect to the spine. One of the corners of the printed products is then respectively aligned at stops.

Further advantageous features ensue from the invention as described in detail below when considered in conjunction wit the accompanying drawings.

DETAILED DESCRIPTION OF THE INVENTION

Figure 1:
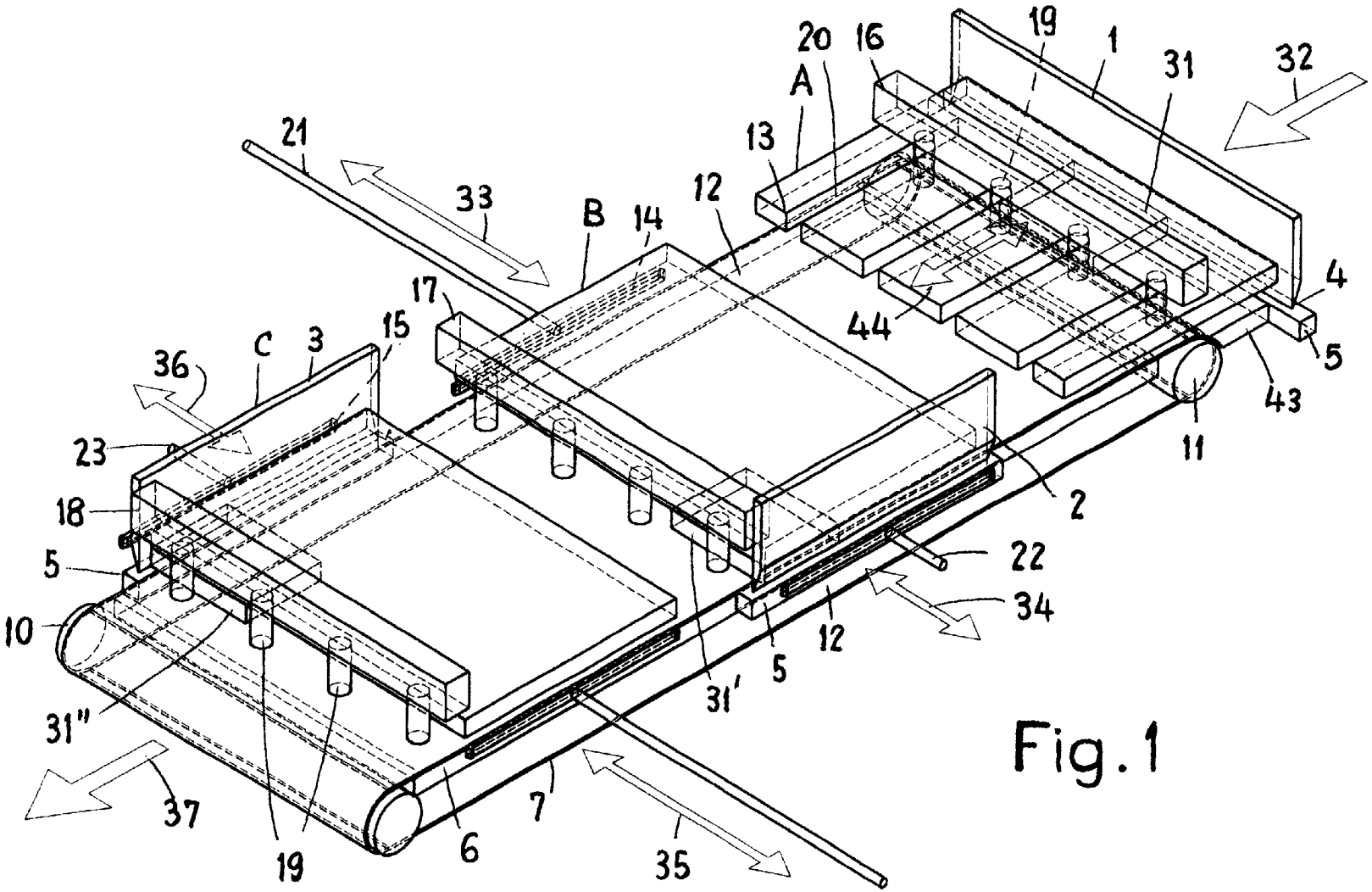
FIG. 1 shows a schematic, perspective view of an apparatus in accordance with the invention.
Figure 3:
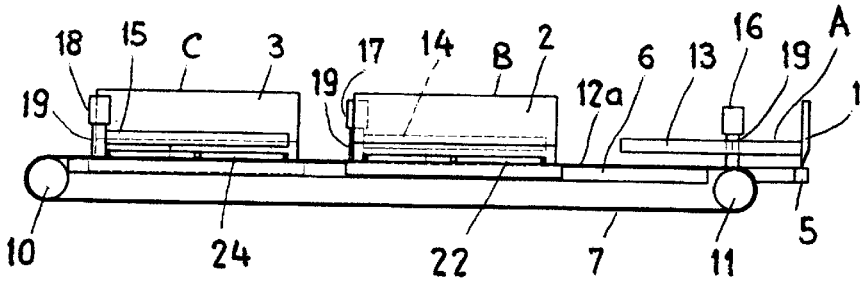
FIG. 3 shows a side view of the apparatus in accordance with FIG. 1.
Figure 2:
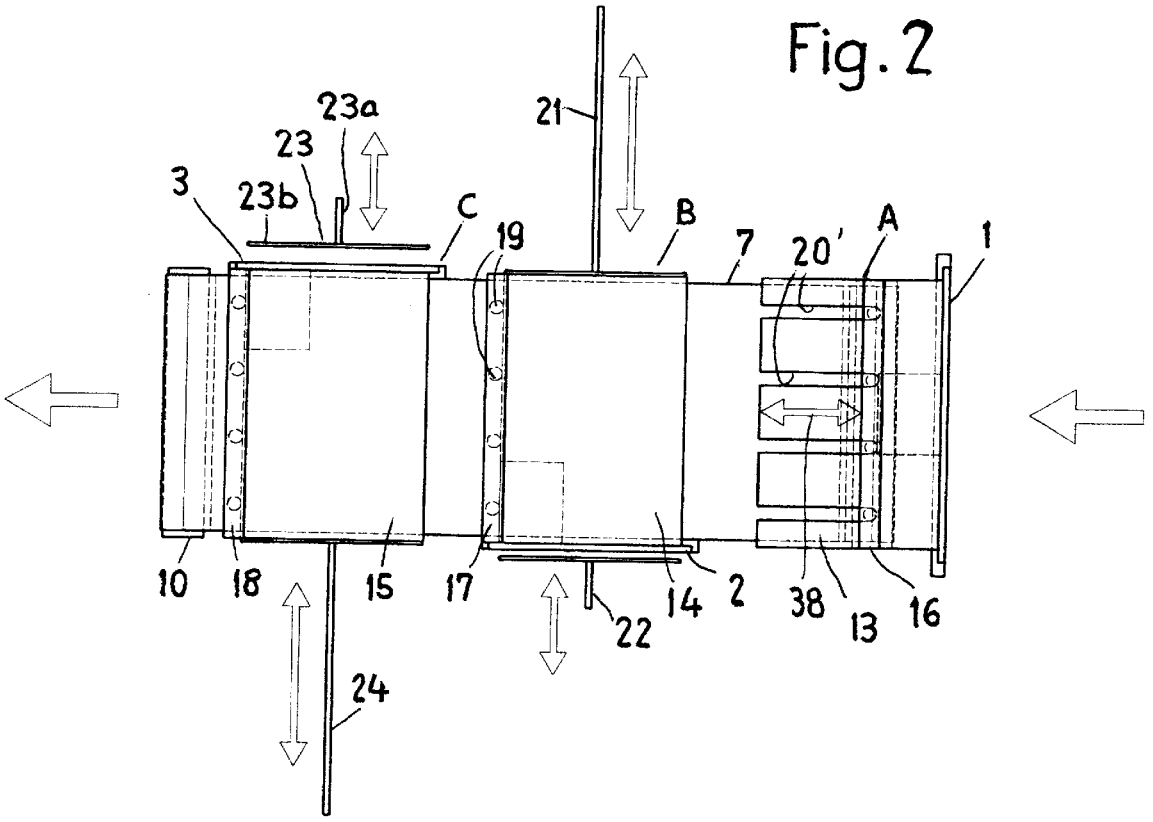
FIG. 2 shows a plan view of the apparatus in accordance with FIG. 1.

The apparatus shown in FIGS. 1 through 3 has three trimming stations A, B and C, which are disposed in a line, one behind the other, on a horizontally-oriented trimming table 6. Each trimming station has a blade 1, 2 and 3, respectively, which is driven vertically in a known manner to make a cut. Each blade has a lower trimming edge 4 that cooperates with a trimming tab 5 secured to the trimming table 6, or with a lower blade.

Each station A, B and C is provided with a pressing plunger 13, 14 and 15, respectively, which can move vertically, with means not shown here, for the pressing action. The pressure exerted downward for the pressing action is preferably cushioned with springs, not shown here. A person of skill in the art is familiar with the drive for pressing plungers.

The apparatus has a transport device 7, which comprises an endless transport belt 12 that travels around a drive roller 10 and a diverting roller 11 and, as can be seen, is essentially as wide as the pressing plungers 13, 14 and 15. The upper run of the transport belt 12 travels above the trimming table 6 and below the pressing plunges 13, 14 and 15. A fixed tab 43 that constitutes a part of the trimming table 6, but is located outside of the region of the transport device 7, is disposed between the diverting roller 11 and the blade 1. The transport direction of the sport device 7 is indicated by the arrows 32 and 37 in FIG. 1. It therefore travels from the top right to the lower left in FIG. 1.

Each trimming station A, B and C has a stop element 16, 17 and 18, respectively. On their underside, these elements have a plurality of spaced pins 19, which end just above the upper run of the transport belt 12. The stop elements 16, 17 and 18 call be individually and infinitely-variably adjusted in the transport direction of the transport device 7, as well as in the opposite direction, with drive elements not shown here. In the station A, tie pins 19 extend through a respective slot 20 of the pressing plunger 13. The stop element 16 can therefore be adjusted in the region of the pressing plunger 13. The stop elements 17 and 18 are located in front of the pressing plunger 14 and 15, respectively, seen in the transport direction.

The trimming stations B and C also have a slide 21 and 22 or 23 and 24, as can be seen particularly clearly in FIG. 2. These slides 21 through 24 cm be individually displaced with drive elements, not shown here, in the directions of the two-headed arrows 33 through 36, The slides 21 through 24 are disposed between the pressing plunger 14 or 15 and the upper run of the transport belt 12. They each have a slide rod and a positioning part that extends transversely to the rod. In the example of the slide 23 in FIG. 2, the slide rod is represented by 23*a* and the positioning part is represented by 23*b*. FIG. 3 clearly shows how the slides 21 trough 24 are respectively disposed between the upper run 12*a* and the pressing plunger 14 or 15. The slides 21 through 24 could also be replaced by other positioning means, particularly transport belts.

In the trimming process, a transport device, not shown here, such as a transport belt conveys a printed product 31 to the first trimming station A in the direction of the arrow 32 in FIG. 1. The blade 1 is raised from the trimming tab 5. The printed product 31 is supplied to the station A such that its bound spine rests against the stop element 16, and thus against pins 19, and is aligned by them. In the aligned position, at least a region of the product is located on the transport device 7. Of course, the pressing plunger 13 is also raised when the printed product 31 is positioned and aligned at the stop element 16. When the printed product 31 has been positioned and aligned, it is pressed with the pressing plunger 13; the stroke of the blade 1 then makes a front cut. The stop elements 16 determine the position of the front cut. For a different format, the stop elements 16 are displaced correspondingly in the directions of the two-headed arrow 44.

After the front cut has been made, the pressing plunger 13 is raised, and the transport device 7 transports the printed product 31 to the second trimming station B, where the product is held against the stop element 17. The slides 21 and 22 displace the printed product 31' transversely to the transport direction of the sport device 7, and position and align it for the bottom cut. The pressing plunger 14 and the blade 2 are raised here. When the printed product 31' has been positioned and aligned, it is pressed with the pressing plunger 14, and a stroke of the blade 2 makes the bottom cut.

When the product 31' has been processed in the trimming station B, the pressing plunger 14 is raised and the transport device 7 transports the printed product 31' to the third and final trimming station C. Here, the printed product 31' is held against the stop element 18. The slides 23 and 24 position and align the printed product 31' for the top cut. The top cat is made through pressing with the pressing plunger 15 and a stroke of the blade 13. The printed product 31" is now trimmed on the three open side edges, and, after the pressing plunger 15 has been raised, the transport device 7 transports it in the direction of the arrow 37 to a further transport device or another processing station.

Three printed products 31 can be trimmed simultaneously in the device. The trimming stations A, B and C can therefore process a printed product 31, 31' and 31" simultaneously and within a cycle. The output is comparable to tat of the known devices of this type. The printed products 31, 31' and 31" can have different formats. For example, the printed product 31" could have essentially the format of the pressing plunger 15. In this case, it would only be necessary to adjust the slides 23 and 24 to the format of the printed product 31". The stroke of the blade 3 and the function and arrangement of the pressing plunger 15 need not be altered.

Figure 4:
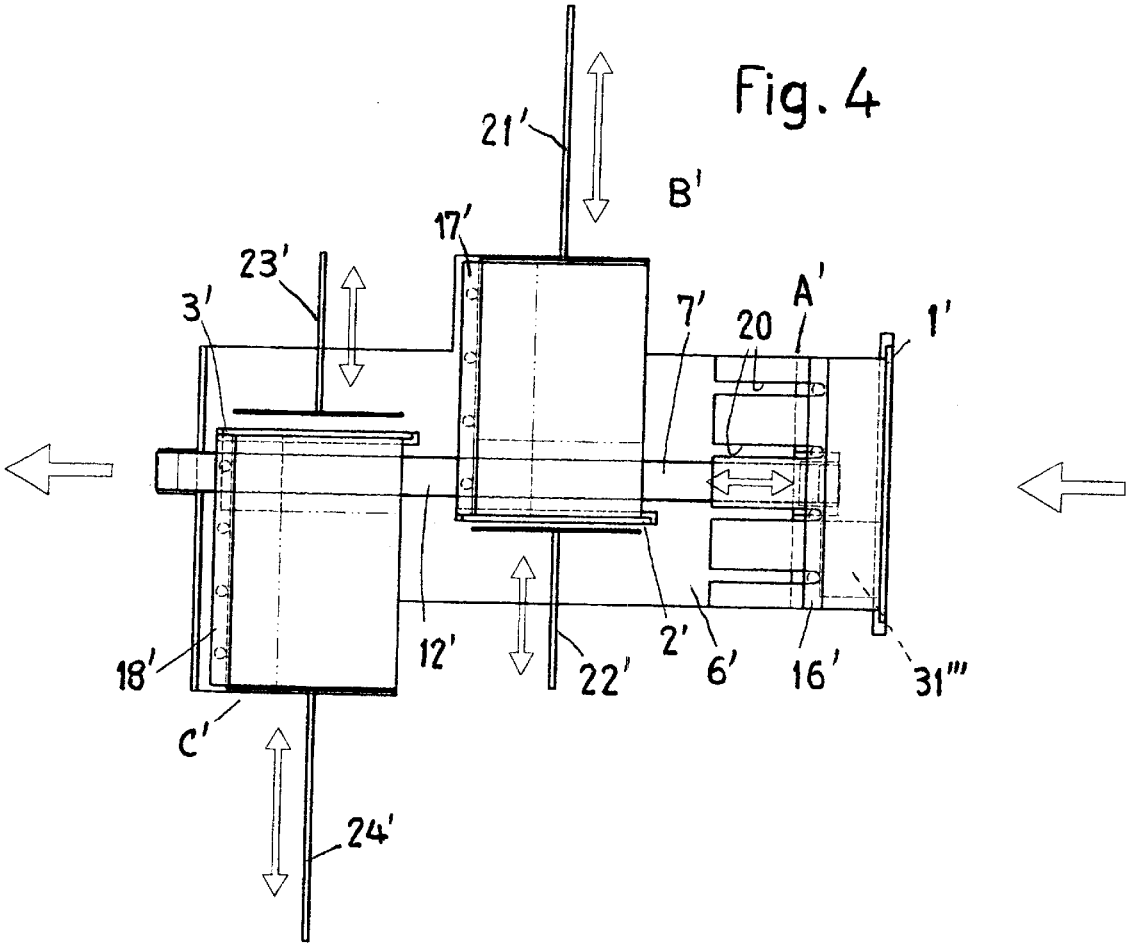
FIG. 4 shows a plan view of a variation of the novel apparatus.

The embodiment in accordance with FIG. 4 basically differs from that of FIGS. 1 through 3 in the arrangement of the trimming stations A', B' and C', and the embodiment of a transport belt 12'. Relative to the trimming station A', the trimming stations B' and C' are laterally offset in the transport direction of the transport belt 12'. A trimming table 6' having a corresponding embodiment is provided. The purpose of this offset arrangement of the trimming stations B' and C' is to allow a printed product 31'" having a very small format to be trimmed with only very short aligning and positioning movements. The transport path of the printed product 31'" is therefore basically linear. As can be seen, the transport device 7' is comparatively narrow, and only occupies a partial region of the trimming table 6'. The blades 1', 2' and 3' are likewise preferably stationary. The displacement of the stop elements 16', 17' and 18' and the adjustment of the slides 21', 22', 23' and 24' effect the alignment and positioning of the printed product 3'".

Figure 5:
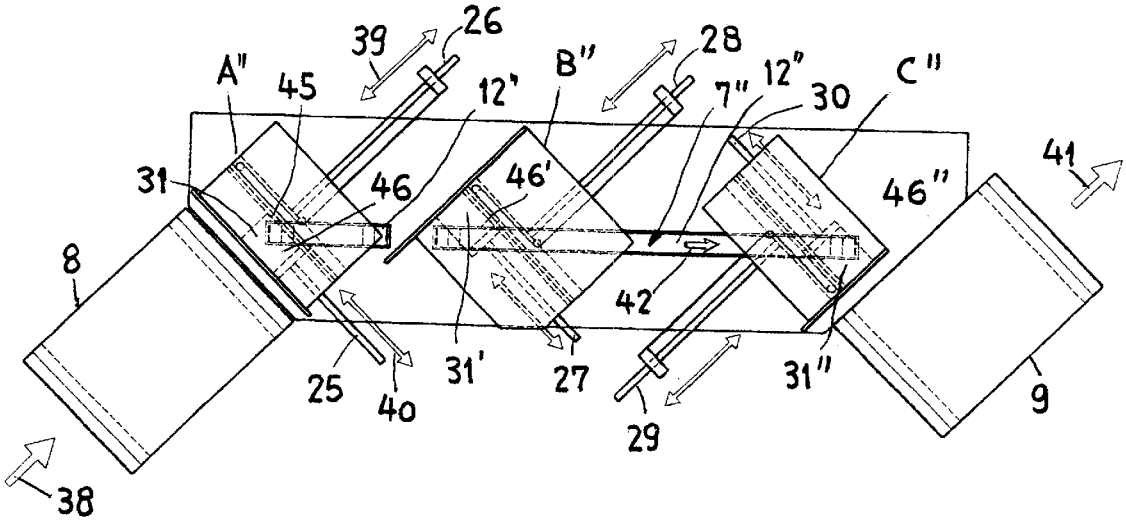
FIG. 5 shows a plan view of a further variation of the novel apparatus.

In the embodiment in accordance with FIG. 5, the trimming stations A", B" and C" are disposed such that printed products 31, 31' and 31" are guided through the trimming stations A", B" and C" at an angle relative to a spine 45. The slides 25 through 30 orient the printed products 31, 31' and 31'" at a comer 46, 46' and 46", respectively. A transport device 7" comprises two spaced transport belts 12". A transport belt 8 transports the printed products 31 to this apparatus in the direction of the arrow 38, and thus, as can be seen, also at an angle to the transport direction 42 of the transport device 7". A transport belt 9 effects the discharge in the direction of the arrow 41. Two-headed arrows, such as 39 and 40, indicate the correspondingly inclined displacement of the slides. The advantage of this embodiment is that the stations A", B" and C" only require two respective slides 25 and 26, 27 and 28 or 29 and 30. No additional stop elements are required. The positioning device is therefore especially simple in this embodiment.

Figure 6:
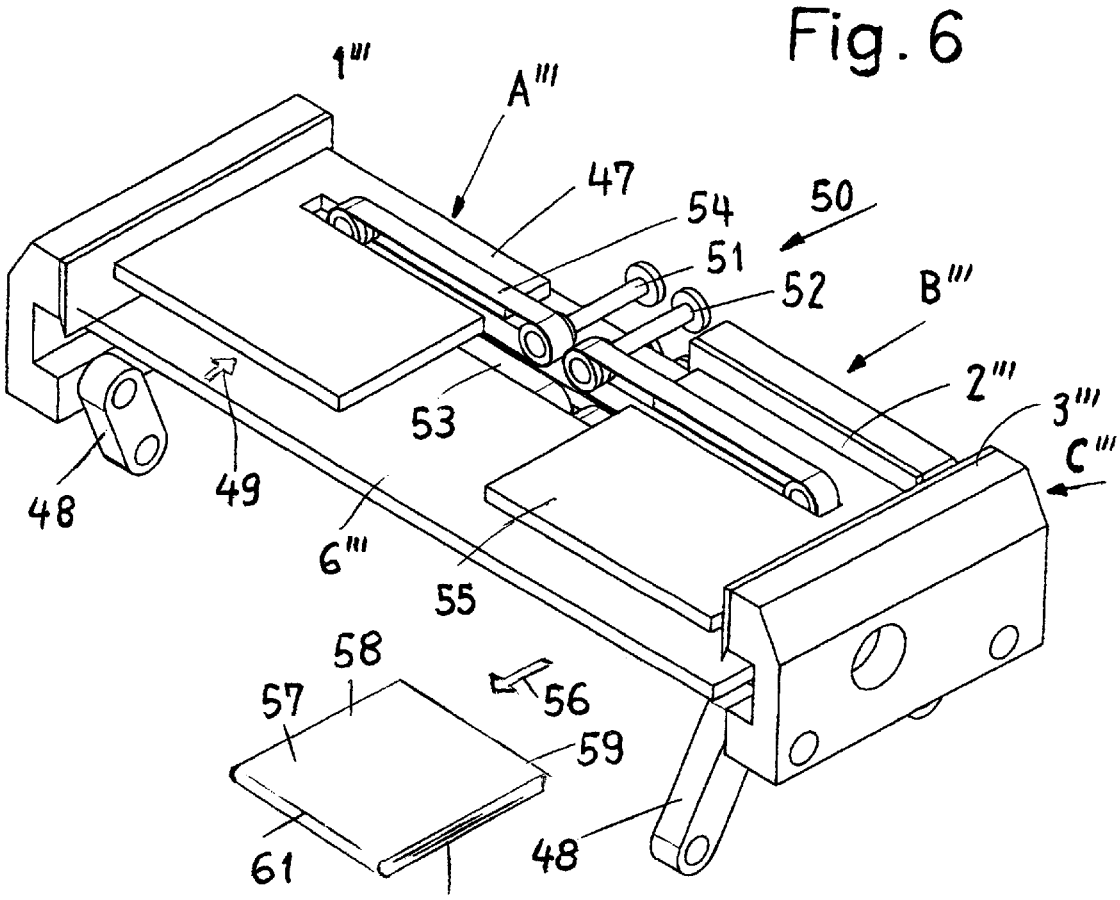
FIG. 6 shows a schematic, perspective view of a further variation of an apparatus in accordance with the invention.

In tile embodiment in accordance with FIG. 6, a trimming table 6" is likewise provided as the trimming support surface; here, the table is oriented horizontally, but can also be inclined relative to the horizontal. A first trimming station A'" is provided with a blade 1'", a pressing plunger 47 and, for transport and positioning, a unit 51 of a transport deice 50. These slides position an untrimmed printed product (not shown) for the top out when the pressing plunger 47 and the blade 1'" are raised. The pressing plunger 47 and the blade 1'" are lowered to make the cut. Two cranks 48, only indicated here, are provided for the stroke of the blade 1'". A transport device, not shown here, transports the printed products in the direction of the arrow 49.

After the top cut has been made, the transport device 50, which comprises two units 51 and 52, each having a lower belt 53 and an upper belt 54, transports the printed product to a second trimming station B'" where the front cut is made with a blade 2'" after the product has been positioned. The unit 52 can be used for positioning in the one direction; it clamps the printed product between the upper belt 54 and the lower belt 53, and is preferably driven independently of the unit 51. The upper belts 54 of the two units 51 and 52 can be respectively lifted. A pressing plunger 55 effects the pressing.

The bottom cut is made in a third trimming station C'", which has a blade 3'" that is moved vertically with cranks 48. The trimming station C'" cooperates with the pressing plunger 55 of the timing station B'", and the unit 52 can be used for positioning for the bottom cut. After the bottom cut has been made, the printed product 57 is ejected with a transport device, not shown, in the direction of the arrow 56. The printed product 57 is thus provided with a top cut 58, a front cut 59 and a bottom cat 60. The binding 61 is not used for positioning in this embodiment The invention has been described in detail with respect to preferred embodiments, and it will now be apparent from the foregoing to those skilled in the art, that changes and modifications may be made without departing from the invention in its broader aspects, and the invention, therefore, as defined in the appended claim, is intended to cover all such changes and modifications that fall within the true spit of the invention.

What is claimed is:

1. An apparatus for automatically trimming three open side edges of printed products bound along a fourth edge to a desired format for each printed product, the printed products being transported in a transport direction along a surface of a trimming table, comprising:

first, second and third trimming stations located one after the other in the transport direction along the trimming table, each trimming station including; a trimming device having at least one stationary blade that can be driven in a plane extending perpendicular to the surface of the trimming table, a positioning device for positioning one of the open side edges of a respective printed product on the trimming table to be cut and a pressing device, with which a respective positioned printed product can be pressed over essentially the entire format during a cut of the positioned open side edge; and a transport device for transporting a respective printed product from the first trimming station to the second trimming station, and from the second trimming station to the third trimming station.

2. The apparatus according to claim 1, wherein the positioning device of at least one of the trimming station has at least one slide with which the printed products are positioned and aligned in the respective station.

3. The apparatus according to claim 1, wherein the at least one blade at each station has a fixed position.

4. The apparatus according to claim 1, wherein the positioning devices of the second trimming station and the third to trimming station, respectively, each have at least one slide, with which the respective printed products can be aligned for the cut.

5. The apparatus according to claim 1, wherein the positioning device of at least one of the stations includes a stop at which the bound side edge of the respective printed products is aligned.

6. The apparatus according to claim 5, wherein the stop is adjustable transversely to a direction of the edge to be trimmed.

7. The apparatus according to claim 1, wherein the blade of one of the trimming stations and the blade of another of the trimming stations are parallel and at a distance from one another for performing a top out and a bottom cut respectively, of the respective printed products.

8. The apparatus according to claim 7, wherein the blade of a remaining one of the trimming stations for a front cut is disposed at an angle relative to the parallel blades.

9. A method for automatically trimming three open side edges of printed products bound along a fourth edge to a desired format for each printed product, comprising:

transporting the printed products in a transport direction along a surface of a trimming table to three consecutive trimming stations, each trimming station including a blade, a positioning device and a pressing device;

positioning each printed product in each station for cutting a different one of the open side edges;

pressing each positioned printed product in each printing station essentially over the entire format; and cutting the different one of the open side edges in each trimming station.

10. The method according to claim 9, wherein the transporting step includes transporting the printed products after a first cut in a first one of the trimming stations to a second one of the trimming stations; and the positioning step includes displacing the printed product in the second trimming station transversely to the transport direction to position the printed product in this trimming station and thereby position the printed product relative to the blade of the second trimming station that extends in the transport direction.

* * * * *